United States Patent [19]

Gunneman

[11] 4,372,348

[45] Feb. 8, 1983

[54] BLOWING NOZZLE HAVING A SHIELDED BLOWING APERTURE, ADAPTED FOR USE IN A SHUTTLELESS WEAVING MACHINE

[76] Inventor: Paul Gunneman, Medevoort 15, 5731 RM Mierlo, Netherlands

[21] Appl. No.: 232,160

[22] Filed: Feb. 6, 1981

[30] Foreign Application Priority Data

Feb. 11, 1980 [NL] Netherlands ..... 8000836

[51] Int. Cl.[3] ..... D03D 47/28

[52] U.S. Cl. ..... 139/435

[58] Field of Search ..... 139/435; 226/97

[56] References Cited

U.S. PATENT DOCUMENTS 4,304,269 12/1981 Suzuki et al. ..... 139/435

FOREIGN PATENT DOCUMENTS 2022630 12/1979 United Kingdom .

*Primary Examiner*—Henry Jaudon

*Attorney, Agent, or Firm*—C. O. Marshall, Jr.

[57] ABSTRACT

A blowing nozzle for a shuttleless weaving machine, in the shape of a hollow needle with a single blowing aperture or a plurality of elementary apertures in its side wall. The mouth of each aperture is recessed with respect to a surface surrounding it in order to prevent scraping material from warp threads moving past the nozzle. Such material could otherwise block the aperture.

3 Claims, 4 Drawing Figures

BLOWING NOZZLE HAVING A SHIELDED BLOWING APERTURE, ADAPTED FOR USE IN A SHUTTLELESS WEAVING MACHINE

The invention relates to a blowing nozzle in the shape of a hollow needle having a blowing aperture provided in its side wall and comprising a single aperture or a plurality of elementary apertures, particularly adapted for supplying a jet of fluid as the transport carrier for a thread in a textile machine.

Such a blowing nozzle having a single blowing aperture is known from the Dutch patent application No. 7005782 (=U.S. Ser. No. 135,268, British Pat. No. 1,333,948, French Pat. No. 7113684, Japanese Pat. No. 835.397) while a similar blowing nozzle having a plurality of elementary apertures is known from the Dutch patent application No. 7406857 (=U.S. Pat. No. 3,978,896, British Pat. No. 1,510,865, French Pat. No. 7515815, Italian Pat. No. 1.041.756, Japanese Pat. No. 55/36735).

Due to the very small diameter of the apertures, e.g. a fraction of a millimeter, there is a chance of blocking by thread fluff or by dye or similar coating material scraped from the warp threads moving past the apertures, caused by the edge of the mouth of an aperture. It will be clear that in that case, particularly in a nozzle having a single aperture, the direction of the transport fluid flow issuing from the nozzle may deviate from the correct direction. In the above mentioned application No. 7406857 it is explained that deviations of the direction are not allowable since a.o. they cause the impulse transmission of the fluid to the thread to be less effective.

Moreover, by the scraping action of the sharp edge of the mouth on the warp threads these become damaged, i.e. weakened and roughened. The hairlike strands extending from the warp threads and caused by the roughening hinder the weft thread in its progression through the weaving shed so that weaving errors may occur. Moreover, rough threads are inadmissible per se with certain filament yarns.

The invention aims at removing the said disadvantages.

This is achieved by the invention in that the mouth of the blowing aperture is recessed with respect to a surface situated around the aperture.

Due to the recessed aperture there is less chance that fibres or coating material of the threads enter the mouth of the aperture. Furthermore the transition of the surface situated around the blowing aperture towards this aperture may be rounded or radiused so that the scraping action on the threads is removed. For the mouth of the aperture is hardly allowed to be rounded because this increases the spread of the fluid jet and thereby again the effect of the jet is decreased. The influence of the rounding is large due to the small ratio of the length to diameter of the aperture (l/d), particularly with a single aperture.

In a preferred embodiment according to the invention the mouth of the blowing apparatus is recessed in that the surface situated around the blowing aperture, with respect to which the blowing aperture mouth is recessed, is constituted by the surface of the side wall in which the blowing aperture has been provided.

In another embodiment according to the invention the surface around the blowing aperture is constituted by a ridge extending beside the blowing aperture and being raised with respect to the side wall surface.

If more than one blowing aperture is provided or if the blowing aperture comprises a plurality of elementary apertures the recessed provision may also be obtained in that beside each aperture or group of apertures respectively each time a number of raised ridges are provided.

The invention will be hereunder further illustrated with reference to the drawing in which some embodiments as examples of the blowing nozzle according to the invention are shown.

Figure 4:
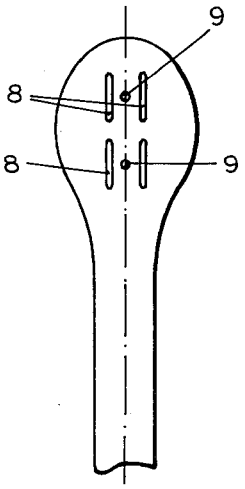

FIG. 4 finally shows a plan view of the discharge surface of the needle having two elementary apertures, with beside each aperture raised ridges.

Figure 1:
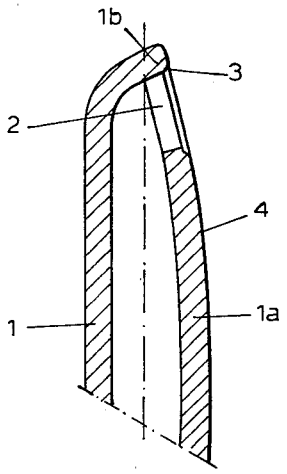
FIG. 1 is a longitudinal section on an enlarged scale through the blowing nozzle having a single discharge aperture.
Figure 1A:
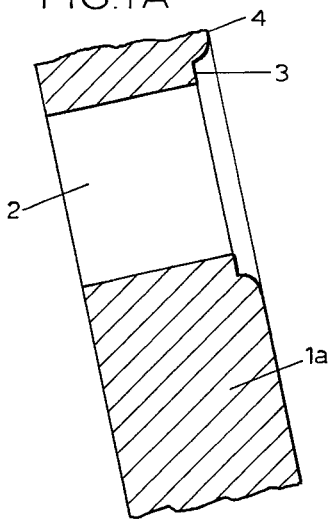
FIG. 1A shows still further enlarged the portion of the nozzle at the position of the discharge aperture.

The blowing nozzle according to FIG. 1 comprises a hollow needle 1 which is provided in its side wall 1*a* adjacent the "point" 1*b* of the needle, with a single aperture 2. The outer end of the aperture 2 is surrounded by an annular surface 3 which is recessed with respect to the outer surface 4 of the side wall 1*a*. The arrangement is shown in FIG. 1A on an enlarged scale. The transition of the recessed surface 3, extending annularly around the aperture 2, towards the side wall surface 4 is here shown as having a rather pronounced rounding or radius.

Figure 2:
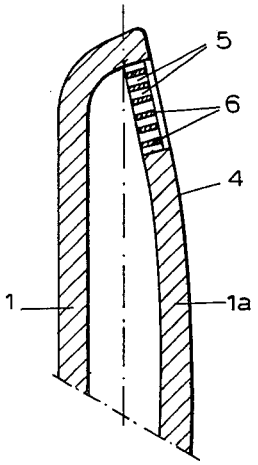
FIG. 2 is a longitudinal section through a nozzle having a plurality of elementary apertures, the mouth of the apertures being recessed with respect to the exterior of the side wall surface in which the aperture has been provided.

FIG. 2 shows an embodiment of the blowing nozzle likewise comprising a hollow needle 1, discharge apertures being formed in the side wall 1*a* thereof. These apertures comprise here a large number of elementary apertures 5, distributed equally spaced. The partition wall material between said elementary apertures 5 forms a surface 6 at the discharge side of the nozzle, which is recessed with respect to the exterior surface 4 of the side wall 1*a*. Also here the transition between the surfaces 4 and 6 may be rounded or radiused.

Figure 3:
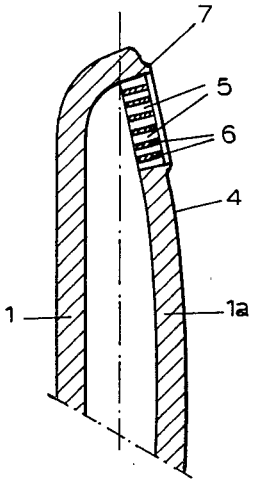
FIG. 3 shows a different embodiment having a plurality of elementary apertures, the mouth of said apertures being in the same plane as the side wall surface but a raised edge having been provided around the apertures.

FIG. 3 shows an embodiment in which the needle side wall 1*a* likewise comprises a large number of elementary apertures 5. The partition material between the apertures 5 forms a surface 6 at the discharge side of the nozzle, said surface here being situated in the same plane as the exterior surface 4 of the wall 1*a*. However, a raised ridge 7 has been provided around the apertures 5, on the surface 4, whereby the mouths of the nozzle apertures are recessed with respect to the ridge extending around these mouths. Preferably the ridge 7 is connected through radiuses with the surface 6 and with the surface 4.

When a small number of elementary apertures has been provided, e.g. two of such apertures, the raised ridge according to FIG. 3 may also be replaced by separate raised ridges 8, provided beside each elementary aperture 9 (see FIG. 4). The distance between the inner side of each ridge 8 and the centre of the aperture 9 then must be somewhat greater than the radius of the aperture 9 since otherwise, as said above, the fluid jet leaving the aperture is spreaded to much, i.e. does not act sufficiently concentrated on the weft thread. This corresponds to the embodiment according to FIG. 1 in which likewise a surface 3 has been provided between the "raised edge" as supplied there and the aperture 2.

It will be clear that with different numbers of elementary apertures per nozzle the ridges beside said apertures may have forms differing from those shown in the drawing.

I claim:

1. A blowing nozzle, for supplying a jet of fluid to assist in transporting a weft thread through a weaving shed, which is in the form of a hollow needle having at least one blowing aperture in its side wall, the outer end of said aperture being surrounded by a first surface which is recessed relative to a second surface on the needle adjacent to said first surface, characterized in that the second surface has a rounded edge adjacent to the first surface.

2. A blowing nozzle according to claim 1, characterized in that the second surface is the outer surface of the side wall of the hollow needle.

3. A blowing nozzle according to claim 1, characterized in that the second surface is the outer surface of a ridge extending adjacent to the first surface.

* * * * *